US007633238B2

(12) United States Patent
Kang et al.

(10) Patent No.: US 7,633,238 B2
(45) Date of Patent: Dec. 15, 2009

(54) LAMP DRIVING DEVICE AND DISPLAY APPARATUS HAVING THE SAME

(75) Inventors: Moon-Shik Kang, Seongnam-si (KR); Myung-Joong Youn, Seoul (KR); Jheen-Hyeok Park, Seongnam-si (KR); Gun-Woo Moon, Daejeon (KR); Hyun-Ki Yoon, Gyeongsangbuk-do (KR); Eun-Seok Choi, Jeongju-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 62 days.

(21) Appl. No.: 11/929,223

(22) Filed: Oct. 30, 2007

(65) Prior Publication Data

US 2008/0136344 A1 Jun. 12, 2008

(30) Foreign Application Priority Data

Nov. 2, 2006 (KR) ..... 10-2006-0107927

(51) Int. Cl.
*H05B 41/24* (2006.01)

(52) U.S. Cl. ..... 315/246; 315/247; 315/209 R

(58) Field of Classification Search ..... 315/194, 315/195, 209 R, 210, 209 T, 246, 247, 250, 315/291, 312, 323, 360, DIG. 2, DIG. 5
See application file for complete search history.

(56) References Cited

U.S. PATENT DOCUMENTS

| | | | | |
|---|---|---|---|---|
| 5,396,155 | A * | 3/1995 | Bezdon et al. | 315/291 |
| 6,072,856 | A * | 6/2000 | Van Der Broeck et al. | 378/101 |
| 2004/0145584 | A1 * | 7/2004 | Lee et al. | 345/212 |

FOREIGN PATENT DOCUMENTS

| | | |
|---|---|---|
| JP | 2001-093682 | 4/2001 |
| JP | 2001-118694 | 4/2001 |
| JP | 2004-327116 | 11/2004 |

* cited by examiner

*Primary Examiner*—Douglas W Owens
*Assistant Examiner*—Jianzi Chen
(74) *Attorney, Agent, or Firm*—F. Chau & Associates, LLC

(57) ABSTRACT

A lamp driving device includes first, second, and third voltage converters. The first voltage converter converts a direct current (DC) power voltage to a first pulse voltage. The second voltage converter converts the DC power voltage to a second pulse voltage. The third voltage converter generates a high alternating current (AC) voltage based on the first and second pulse voltages. The lamp driving device generates the high AC voltage without a transformer, so that a manufacturing cost of a display apparatus adopting the lamp driving device may be reduced.

22 Claims, 10 Drawing Sheets

LAMP DRIVING DEVICE AND DISPLAY APPARATUS HAVING THE SAME

CROSS-REFERENCE TO RELATED APPLICATION

This application claims priority to Korean Patent Application No. 2006-107927, filed on Nov. 2, 2006, the disclosure of which is herein incorporated by reference in its entirety.

BACKGROUND OF THE INVENTION

1. Technical Field

The present disclosure relates to a lamp driving device and a display apparatus having the same. More particularly, the present invention relates to a lamp driving device which does not require a transformer, and a display apparatus having the lamp driving device.

2. Discussion of Related Art

Flat display devices, such as a thin-film transistor liquid crystal display (TFT LCD), a plasma display panel (PDP), an organic light emitting diode (OLED), a light emitting diode (LED), etc., are widely used in display apparatuses. The TFT LCD and the PDP have been more widely used because of their low cost.

The PDP includes a self-emissive element as a light source. However, the TFT LCD requires a backlight unit (BLU) as a light source. A cold cathode fluorescent lamp (CCFL) is typically used as a BLU for a TFT LCD.

The TFT LCD may include an inverter for driving the CCFL. The inverter has a high-voltage transformer that boosts a low input voltage of about 24V to a high lamp driving voltage ranging from about 1 kV to about 2 kV. The BLU receives the boosted voltage and emits light.

The high-voltage transformer boosts voltages by having a high-turn ratio so that a low-voltage part and a high-voltage part act as one. The low and high voltage parts are spaced apart from each other to prevent a momentary short, thereby increasing the size of the transformer. However, a transformer having a high turn ratio is more expensive to produce and increases the cost for a TFT LCD that employs such a transformer.

Thus, there is a need for a BLU that does not require a transformer.

SUMMARY OF THE INVENTION

In an exemplary embodiment of the present invention, a lamp driving device includes a first voltage converter, a second voltage converter, and a third voltage converter. The first voltage converter has a first output terminal The first voltage converter converts a direct current (DC) power voltage to a first pulse voltage, and periodically outputs the converted first pulse voltage through the first output terminal. The second voltage converter has a second output terminal. The second voltage converter converts the DC power voltage to a second pulse voltage having a polarity opposite to that of the first pulse voltage and a phase different from that of the first pulse voltage, and periodically outputs the converted second pulse voltage through the second output terminal. The third voltage generator is electrically connected to the first and second output terminals. The third voltage generator generates an AC voltage having a swing width greater than a voltage difference between the first pulse voltage and the second pulse voltage in response to the first and second pulse voltages applied through the first and second output terminals, respectively, and supplies the generated AC voltage to a lamp.

In exemplary embodiment of the present invention, a display apparatus includes a display unit, a lamp, and a lamp driving device. The display unit receives a light to display an image. The lamp receives an alternating current (AC) voltage to emit the light. The lamp driving device supplies the AC voltage to the lamp. The lamp driving device includes a first voltage converter, a second voltage converter and a third voltage converter.

The first voltage converter has a first output terminal. The first voltage converter converts a direct current (DC) power voltage to a first pulse voltage, and periodically outputs the converted first pulse voltage through the first output terminal. The second voltage converter has a second output terminal. The second voltage converter converts the DC power voltage to a second pulse voltage having a polarity opposite to that of the first pulse voltage and a phase different from that of the first pulse voltage, and periodically outputs the converted second pulse voltage through the second output terminal. The third voltage generator is electrically connected to the first and second output terminals. The third voltage generator generates an alternating current (AC) voltage having a swing width greater than a voltage difference between the first pulse voltage and the second pulse voltage in response to the first and second pulse voltages applied through the first and second output terminals, respectively, and supplies the generated AC voltage to the lamp.

BRIEF DESCRIPTION OF THE DRAWINGS

The present invention will become more readily apparent by reference to the following detailed description when considered in conjunction with the accompanying drawings wherein.

DETAILED DESCRIPTION OF EXEMPLARY EMBODIMENTS

Figure 1:
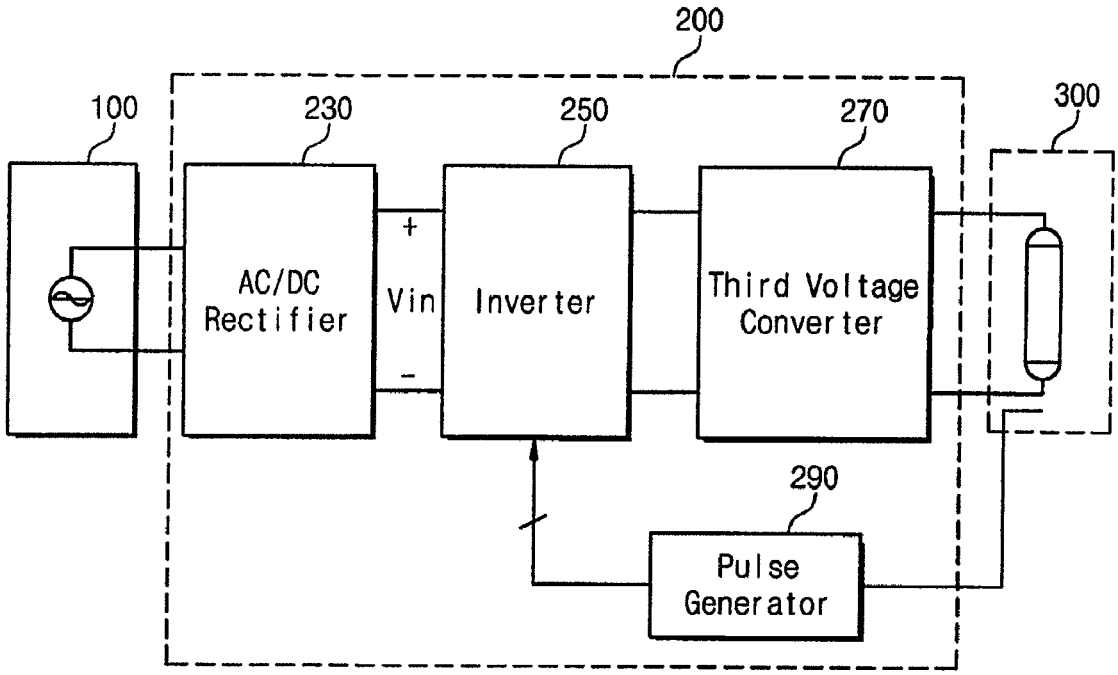
FIG. 1 is a block diagram illustrating a lamp driving device according to an exemplary embodiment of the present invention.

Hereinafter, exemplary embodiments the present invention will be explained in detail with reference to the accompanying drawings. However, the scope of the present invention is not limited to such embodiments and the present invention may be realized in various forms. The same reference numerals are used to designate the same elements throughout the drawings.

FIG. 1 is a block diagram illustrating a lamp driving device according to an exemplary embodiment of the present invention. Referring to FIG. 1, the lamp driving device includes an alternating current (AC) input unit 100 and a lamp driving unit 200.

The AC input unit 100 directly supplies a general-purpose AC voltage ranging from about 100 V to about 240 V to an AC-DC rectifier 230. Typically, the general-purpose AC voltage is output to the lamp driving unit 200 by inserting a plug of the AC input unit 100 into a socket of the lamp driving unit 200.

The lamp driving unit 200 includes the AC-DC rectifier 230, an inverter 250, and a third voltage converter 270. The lamp driving unit 200 receives the general AC voltage from the AC input unit 100, converts the AC voltage to a high-voltage lamp driving voltage, and supplies the high-voltage lamp driving voltage to a lamp 300. The lamp driving unit 200 further includes a pulse generator 290 that detects a lamp current flowing through the lamp 300 and generates a plurality of clock signals based on the detected lamp current. The inverter 250 generates AC voltage of a square wave form in response to the plurality of clock signals.

The AC-DC rectifier 230 has a power factor correction (PFC) function, which converts the general AC voltage ranging from about 100 V to about 240 V to a high direct current (DC) voltage, and directly supplies the converted DC voltage to the inverter 250. The AC-DC rectifier 230 may be embodied using for example, a diode rectifier or an active pulse width modulation (PWM) rectifier.

The inverter 250 can convert a high DC power voltage ranging from 385 V to 400 V to an AC voltage of a square wave form in response to a plurality of switching signals from the pulse generator 290. For example, when supplied with a DC voltage of 400 V from the AC-DC rectifier 230, the inverter 250 outputs a square-wave AC voltage that swings between +800 V and −800 V.

The third voltage converter 270 receives and converts the square-wave AC voltage to a square-wave high AC voltage. The third voltage converter 270 includes a plurality of resonant circuit elements having reactance components. The third voltage converter 270 uses the resonance caused by the reactance components to boost the square-wave AC voltage to a sine-wave AC voltage, which typically ranges from about 1 kV to about 2 kV.

The inverter 250 is electrically connected to the AC input unit 100, which is a power supply. When the AC input unit 100 supplies the inverter 250 with the DC power voltage of about 400 V, the inverter 250 generates the square-wave AC voltage that swings between +800 V and −800 V. The resonant circuit of the third voltage converter 270 boosts the square-wave AC voltage to the sine-wave AC voltage ranging from about 1 kV to about 2 kV, and provides the lamp with the sine-wave AC voltage as a lamp driving voltage.

The lamp driving device employs the resonant circuit instead of a transformer to boost a low voltage to a high voltage, so that the overall size of the lamp driving device may be reduced. Using the resonant circuit in a lamp driving device instead of a transformer may also reduce the cost of manufacturing a liquid crystal display.

Figure 2:
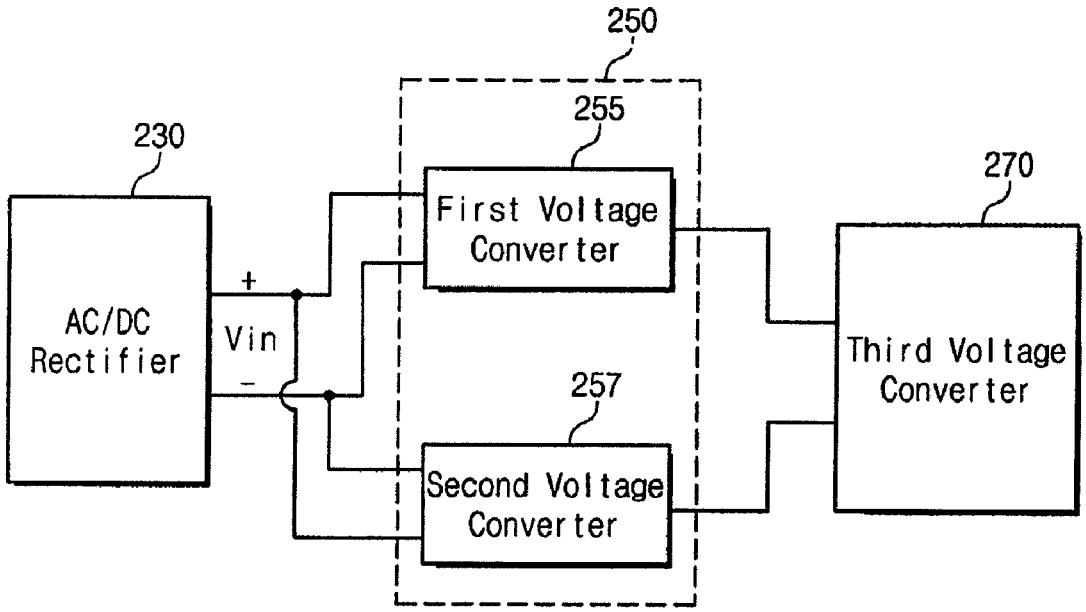
FIG. 2 is a block diagram illustrating an embodiment of an inverter illustrated in FIG. 1.
Figure 3:
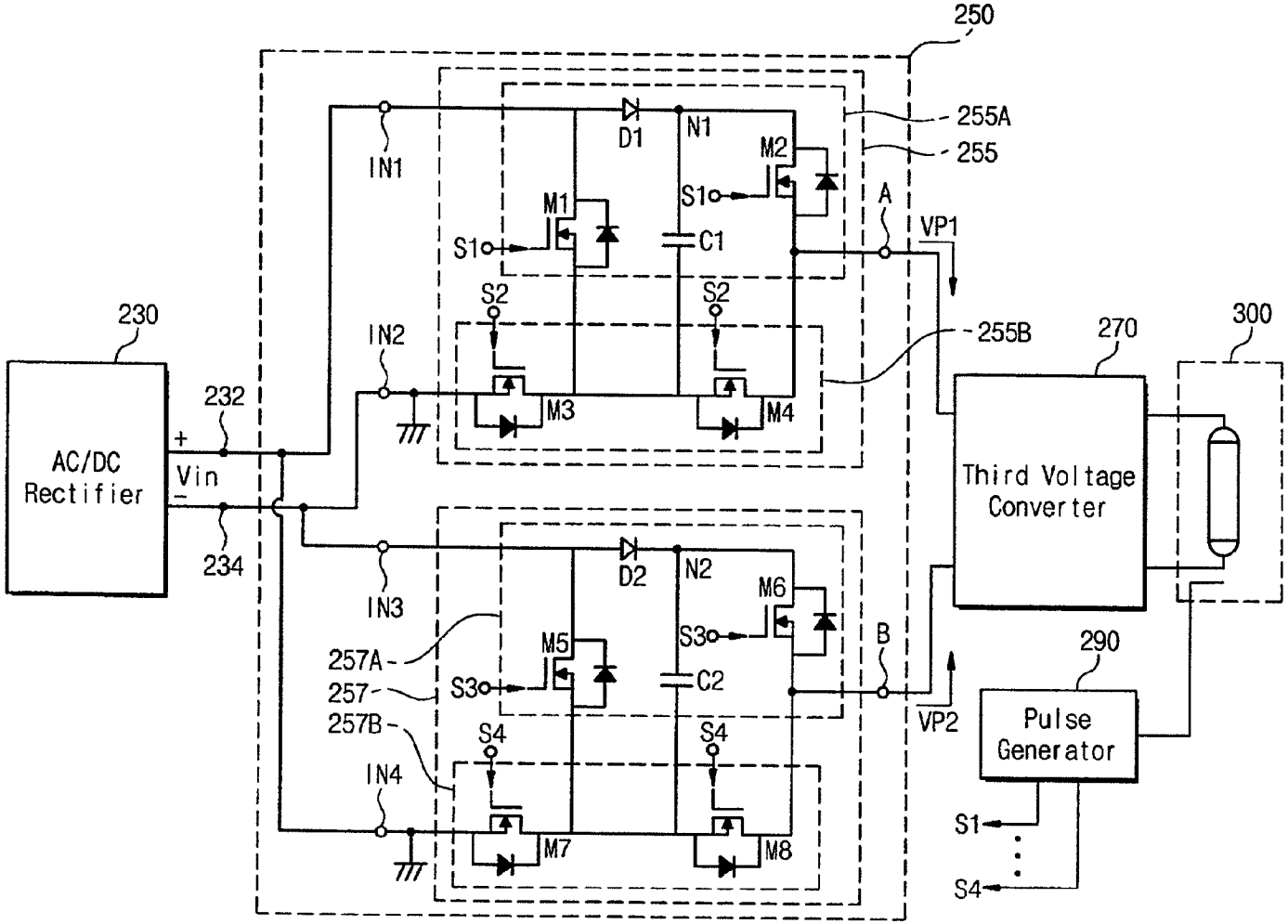
FIG. 3 is a circuit diagram for an embodiment of first and second voltage converters illustrated in FIG. 2.

FIG. 2 is a block diagram illustrating the inverter illustrated in FIG. 1, and FIG. 3 is a circuit diagram for an embodiment of the first and second voltage converters illustrated in FIG. 2.

Referring to FIGS. 2 and 3, the inverter 250 includes a first voltage converter 255 and a second voltage converter 257. The first voltage converter 255 has a first output terminal A. The first voltage converter 255 receives the DC power voltage Vin from the AC-DC rectifier 230, and converts the DC power voltage Vin to a first pulse voltage VP1. The converted first pulse voltage VP1 is periodically output through the first output terminal A.

The second voltage converter 257 has a second output terminal B. The second voltage converter 257 receives the DC power voltage Vin from the AC-DC rectifier 230, and converts the DC power voltage Vin to a second pulse voltage VP2. The converted second pulse voltage VP2 is periodically output through the second output terminal B.

The first voltage converter 255 includes a first voltage booster 255A and a first ground part 255B. The first voltage booster 255A periodically outputs the first pulse voltage VP1 through the first output terminal A in response to an activated first clock signal S1 supplied from a pulse generator 290. The first pulse voltage VP1 has a voltage level corresponding to two times that of the DC power voltage Vin.

The first ground part 255B changes the potential of the first output terminal A (i.e. the voltage level of the first pulse voltage VP1) into a ground part voltage in response to an activated second clock signal S2 supplied from the pulse generator 290.

The activated first and second clock signals S1 and S2 are alternately output from the pulse generator 290, and then are supplied to transistors M1, M2, M3 and M4 of the first voltage converter 255. The second clock signal S2 is activated during a low period of the first clock signal S1, and then is supplied to the first ground part 255B of the first voltage converter 255.

The second voltage converter 257 includes a second voltage booster 257A and a second ground part 257B. The second voltage booster 257A periodically outputs the second pulse voltage VP2 through the second output terminal B in response to an activated third clock signal S3 supplied from the pulse generator 290. The second pulse voltage VP2 has a voltage level corresponding to two times that of the DC power voltage Vin, and a polarity opposite to that of the DC power voltage Vin.

The second ground part 257B changes the potential of the second output terminal B (i.e. the voltage level of the second pulse voltage VP2) into a ground voltage in response to an activated fourth clock signal S4 supplied from the pulse generator 290.

The activated third and fourth clock signals S3 and S4 are alternately output from the pulse generator 290, and then are supplied to transistors M5, M6, M7 and M8 of the second voltage converter 257. The fourth clock signal S4 is activated during a low period of the third clock signal S3, and then is supplied to the second ground part 257B of the second voltage converter 257.

The first voltage converter 255 includes the first voltage booster 255A and the first ground part 255B. The first voltage booster 255A includes the first and second transistors M1 and M2 performing a switching operation in response to the first clock signal S1, a first diode D1, and a first capacitor C1 charged with the DC power voltage Vin.

The first transistor M1 receives the first clock signal S1 through a control electrode thereof and the DC power voltage Vin through a first input terminal IN1 connected to an input electrode (or a drain electrode) thereof. The first transistor M1 is also electrically connected with the first ground part 255B through an output electrode (or a source electrode) thereof.

The second transistor M2 receives the first clock signal S1 through a control electrode thereof, and is electrically connected with a first node N1 through an input electrode (or a drain electrode) thereof. The second transistor M2 is electrically connected with the first output terminal A through an output electrode thereof.

The first diode D1 is connected with the input electrode of the first transistor M1 through an anode terminal thereof, and is electrically connected with the first node N1 through a cathode terminal thereof.

The first capacitor C1 is electrically connected with the first node N1 through a first electrode thereof, and with the first ground part 255B through a second electrode thereof.

The first ground part 255B of the first voltage converter 255 includes the third and fourth transistors M3 and M4, which perform a switching operation in response to the second clock signal S2 activated during a period where the first clock signal S1 is inactivated.

The third transistor M3 receives the second clock signal S2 through a control electrode thereof and the ground voltage through a second input terminal IN2 connected to an output electrode (or a source electrode) thereof. The third transistor M3 is electrically connected with the output electrode of the first transistor M1 of the first voltage booster 255A.

The fourth transistor M4 receives the second clock signal S2 through a control electrode thereof, and is electrically connected with the second electrode of the capacitor of the first voltage booster 255A through an input electrode thereof, and with the first output terminal A through an output electrode thereof.

The second voltage converter 257 includes the second voltage booster 257A and the second ground part 257B. The second voltage booster 257A outputs the second pulse voltage VP2 through the second output terminal B. The second pulse voltage VP2 has a polarity opposite to that of the first pulse voltage VP1 and a phase different from that of the first pulse voltage VP1. The phase of the first pulse voltage VP1 has a difference of 180 degrees, as compared to that of the second pulse voltage VP2.

The second ground part 257B outputs the ground voltage through the second output terminal B in response to the fourth clock signal S4 that is activated in the low period of the third clock signal S3.

The second voltage booster 257A includes the fifth and sixth transistors M5 and M6, a second diode D2, and a second capacitor C2.

The fifth transistor M5 receives the third clock signal S3 through a control electrode thereof and the ground voltage through a third input terminal IN3 connected to an input electrode (or a drain electrode) thereof. The fifth transistor is also electrically connected with the second ground part 257B through an output electrode (or a source electrode) thereof.

The sixth transistor M6 receives the third clock signal S3 through a control electrode thereof, and is electrically connected with a second node N2 through an input electrode, and with the second output terminal B through an output electrode thereof.

The second diode D2 is connected with the input electrode of the fifth transistor M5 through an anode terminal thereof, and is electrically connected with the second node N2 through a cathode terminal thereof.

The second capacitor C2 is electrically connected with the second node N2 through a first electrode thereof, and with the second ground part 257B through a second electrode thereof.

The second ground part 257B includes the seventh and eighth transistors M7 and M8. The seventh transistor M7 receives the fourth clock signal S4 through a control electrode thereof and the DC power voltage Vin through a fourth input terminal IN4 connected to an input electrode thereof. The seventh transistor M7 is also electrically connected with the output electrode of the fifth transistor M5 through an output electrode thereof.

The eighth transistor M8 receives the fourth clock signal S4 through a control electrode thereof, and is electrically connected with the second electrode of the second capacitor C2 through an input electrode thereof, and with the second output terminal B through an output electrode thereof.

Figure 6:
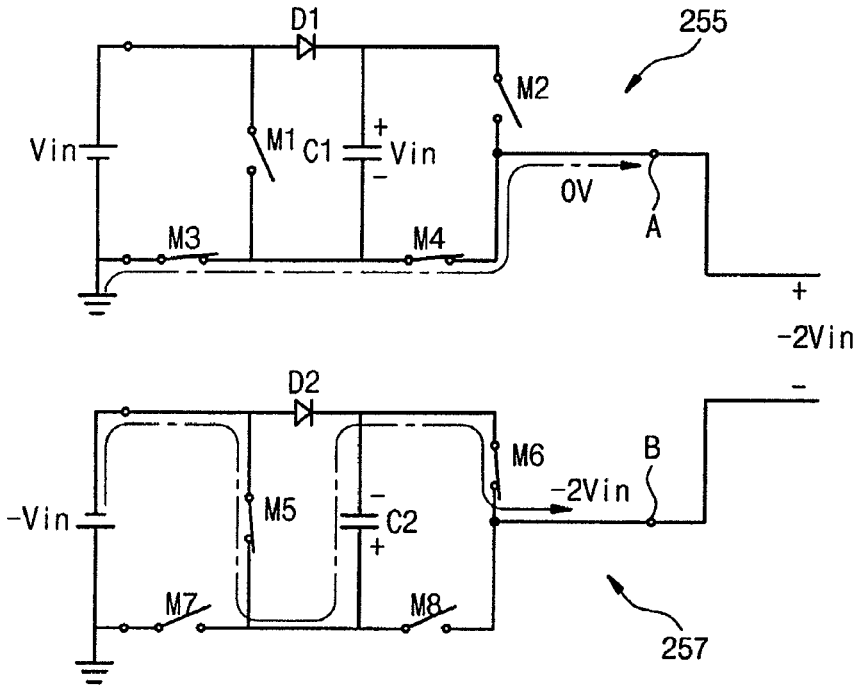
Figure 7:
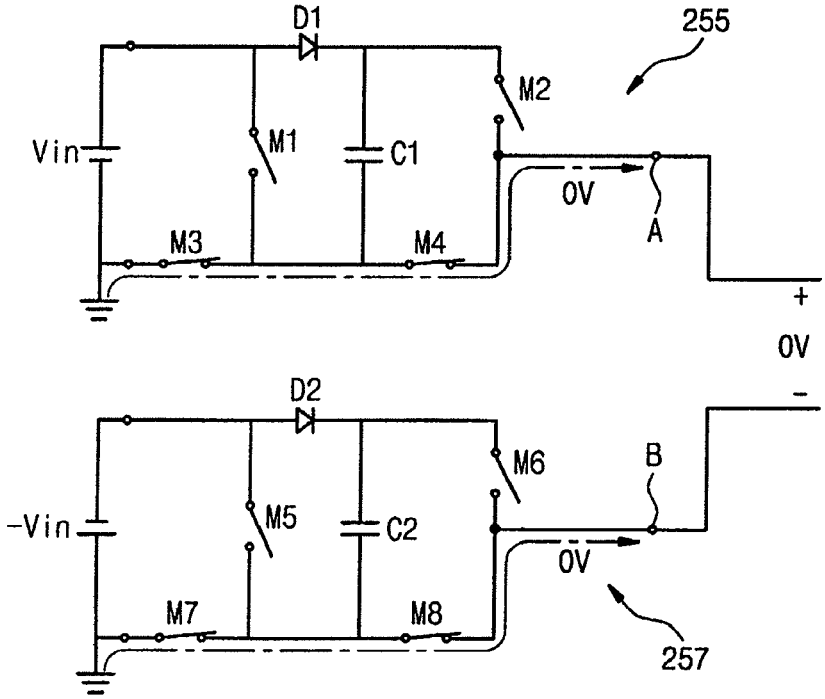
Figure 8:
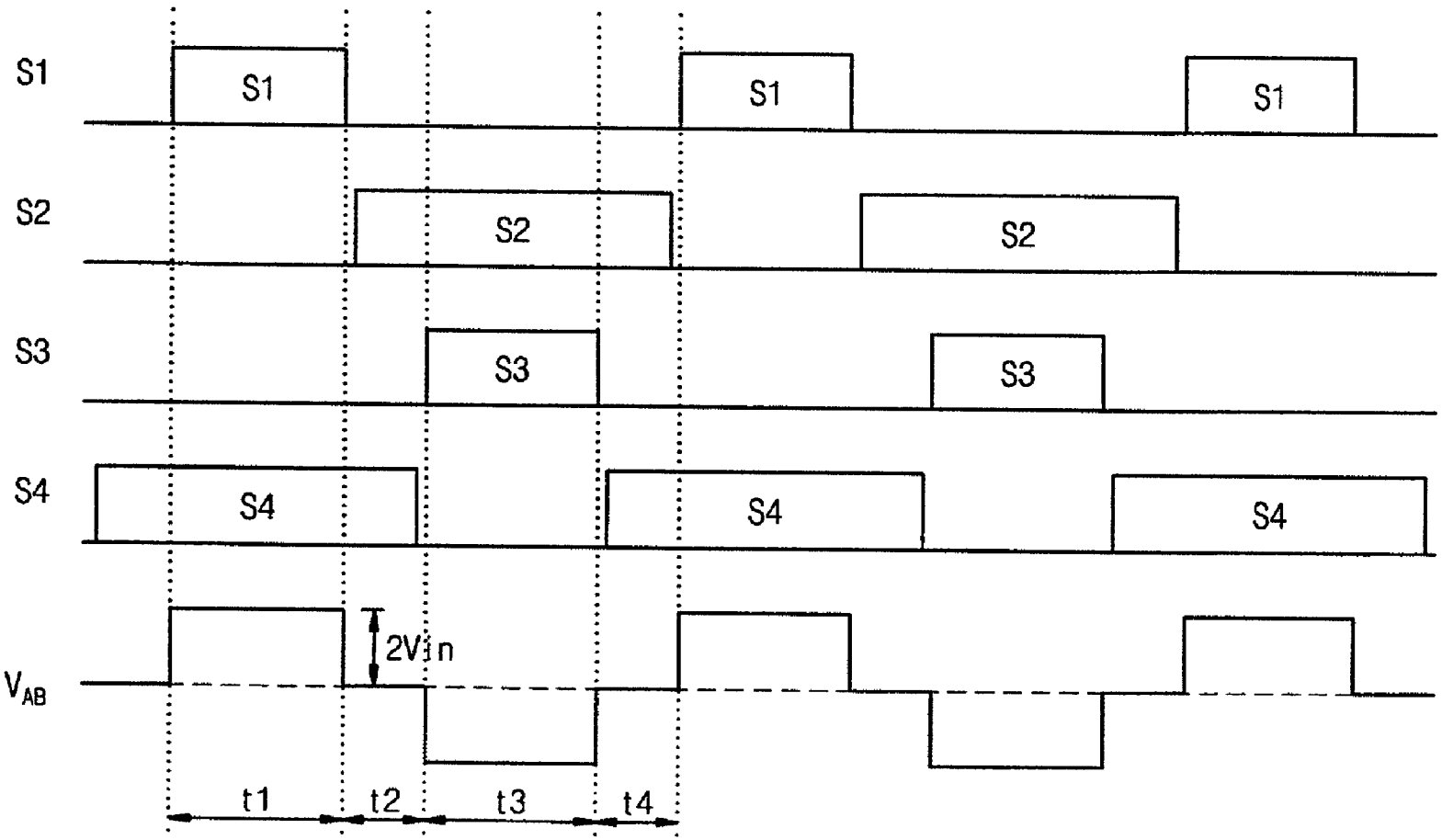
FIG. 8 is a waveform diagram illustrating signal waveforms based on input and output of first and second voltage converters according to an exemplary embodiment of the present invention.

FIGS. 4 through 7 are views illustrating current flow in the circuits for the first and second voltage converters 255 and 257 illustrated in FIG. 3, and FIG. 8 is a waveform diagram illustrating signal waveforms based on input and output of the first and second voltage converters 255 and 257. The following description is made with reference to FIGS. 4 through 8 on the assumption that the first and second capacitors C1 and C2 of the first and second voltage converters 255 and 257 were previously charged to +Vin and −Vin, respectively. The operation of the first and second voltage converters 255 and 257 will be described during four durations t1, t2, t3 and t4. Each of the four durations t1, t2, t3 and t4 constitute one cycle of the voltage waveform $V_{AB}$ illustrated in FIG. 8.

Figure 4:
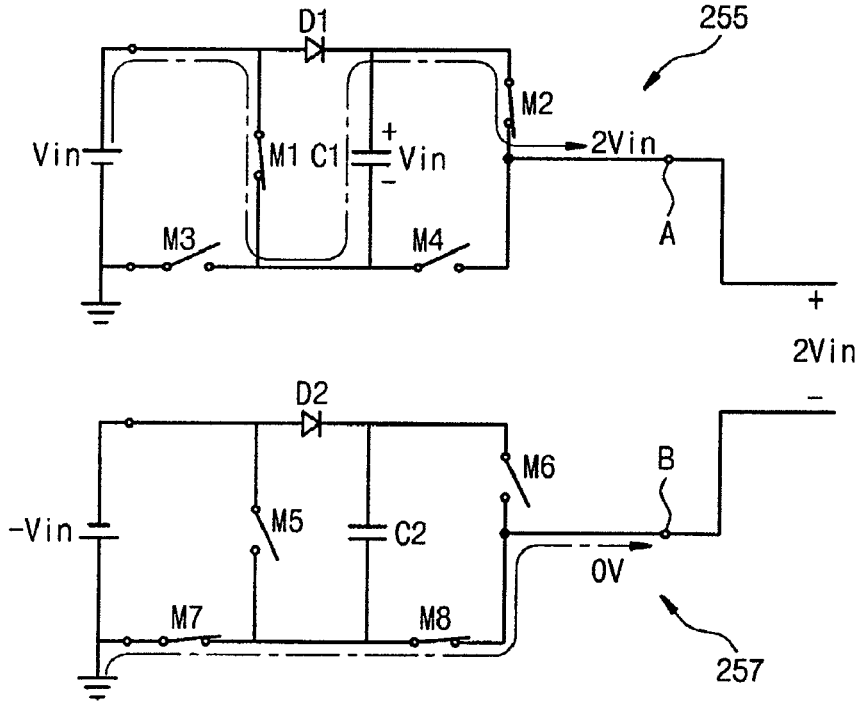
FIGS. 4 through 7 are views illustrating current flow in the circuits for the first and second voltage converters illustrated in FIG. 3.

Referring to FIG. 4, in the first duration t1, the first voltage converter 255 receives the first clock signal S1, and the second voltage converter 257 receives the fourth clock signal S4. In the first duration t1, the first and second transistors M1 and M2 of the first voltage converter 255 and the seventh and eighth transistors M7 and M8 of the second voltage converter 257 maintain an ON state, whereas the other transistors M3, M4, M5 and M6 maintain an OFF state. Thus, in the first duration t1, the first output terminal A maintains a voltage level of 2Vin V, while the second output terminal B maintains a voltage level of a ground voltage (hereinafter, referred to as "zero volt (0 V)").

Figure 5:
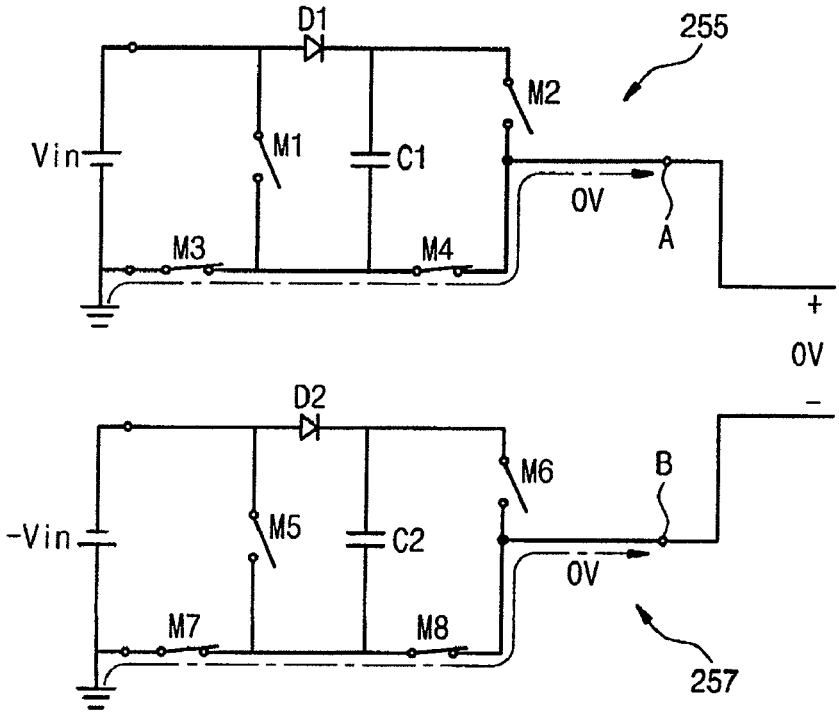

Referring to FIG. 5, in the second duration t2, the third and fourth transistors M3 and M4 of the first voltage converter 255 transition from the OFF state to the ON state, while the seventh and eighth transistors M7 and M8 of the second voltage converter 257 maintain a switched ON state in the first duration t1, with no change. The other transistors M1, M2, M5 and M6 maintain an OFF state.

Accordingly, the first output terminal A transitions from the voltage level of 2Vin V to the voltage level of zero V, while the second output terminal B maintains a voltage level of zero V with no change.

Referring to FIG. 6, in the third duration t3, the third and fourth transistors M3 and M4 of the first voltage converter 255 maintain a switched ON state in the second duration t2, with no change, while the fifth and sixth transistors M5 and M6 of the second voltage converter 257 maintain a switched ON state. Thus, the first output terminal A maintains the voltage level of zero V in the second duration t2 with no change, while the second output terminal B is changed from the voltage level of zero V to the voltage level of −2Vin V.

Referring to FIG. 7, in the fourth duration t4, the seventh and eighth transistors M7 and M8 are turned on in response to the fourth clock signal S4, and thus the second output terminal B transitions from the voltage level of −2Vin V to the voltage level of zero V.

As a result, the AC voltage $V_{AB}$ of a step square wave form has three types of voltage levels and four durations. The step-square-wave AC voltage $V_{AB}$ has the first voltage (2Vin V) that is maintained during the first duration t1, the second voltage (0 V) that is maintained during the second duration t2 following the first duration t1, the third voltage (−2Vin V) that is maintained during the third duration t3 following the second duration t2 and having a polarity opposite to that of the first voltage, and the second voltage that is maintained during the fourth duration t4 following the third duration t3.

The first duration t1 maintained at the first voltage (of 2Vin V) corresponds to a high duration of the first clock signal S1, and the second duration t2 maintained at the second voltage (0 V) corresponds to a duration from when the first clock signal S1 is inactivated to when the third clock signal S3 is activated. The third duration t3 maintained at the third voltage (−2Vin V) corresponds to a high duration of the third clock signal S3, and the fourth duration t4 maintained at the second voltage (0 V) corresponds to a duration from when the third clock signal S3 is inactivated to when the first clock signal S1 is activated. The clock signals S1, S2, S3 and S4 may be combined in various methods to generate various different types of stepsquare-wave AC voltages.

Figure 9:
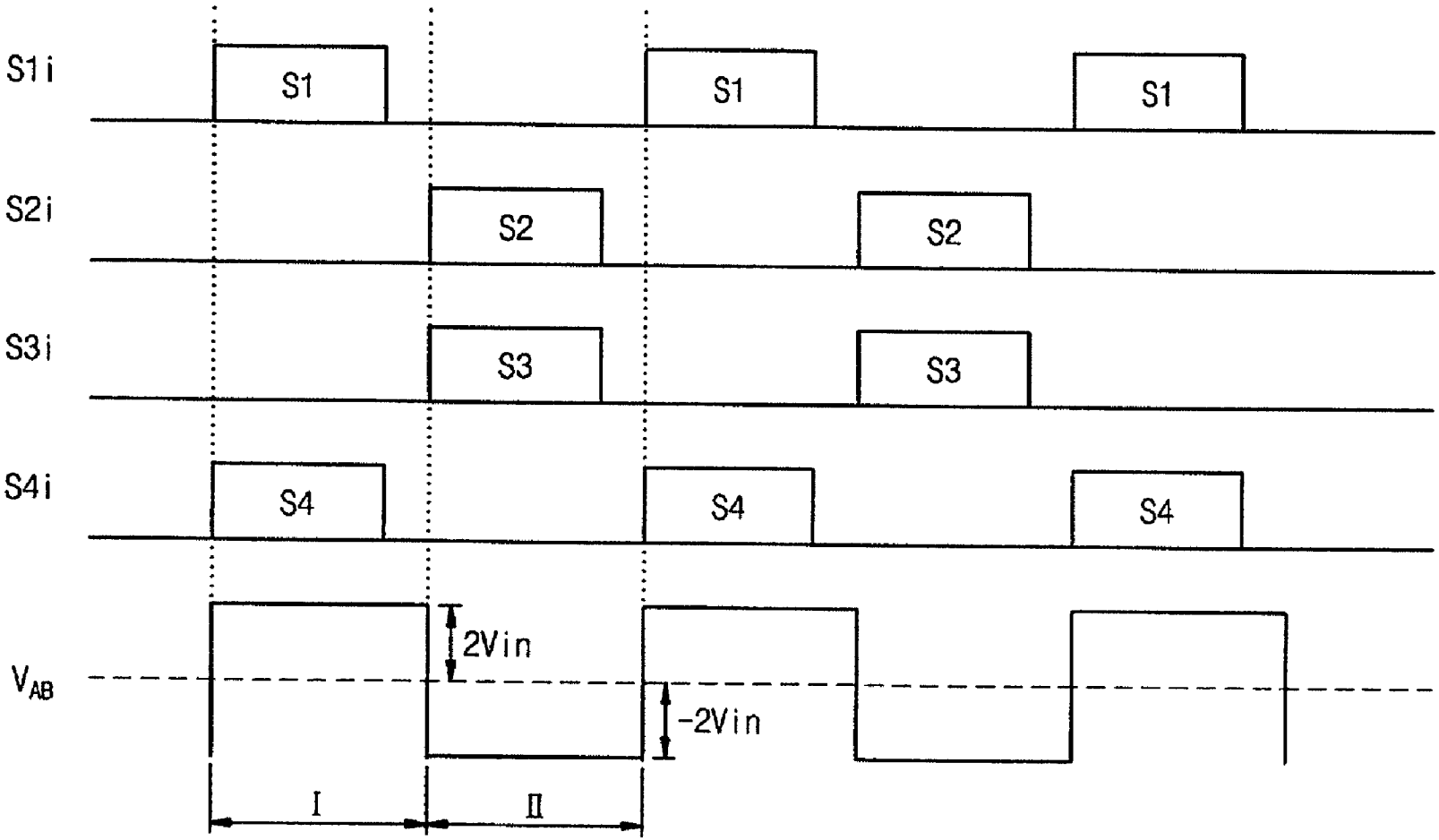
FIG. 9 is a waveform diagram illustrating signal waveforms based on input and output of first and second voltage converters according to another exemplary embodiment of the present invention.

FIG. 9 is a waveform diagram illustrating waveforms of input and output signals of the first and second voltage converters according to an exemplary embodiment of the present invention.

The respective clock signals S1, S2, S3, and S4 illustrated in FIG. 9 perform the same function as those illustrated in FIG. 8. However, the clock signals S1, S2, S3, and S4 illustrated in FIG. 9 maintain high levels during durations having the same length.

The step-square-wave AC voltage $V_{AB}$ illustrated in FIG. 9 has two voltage levels. The two voltage levels include a voltage level of 2Vin V, and a voltage level of −2Vin V. One cycle of the step-square-wave AC voltage $V_{AB}$ illustrated in FIG. 9 has a I duration where the voltage level of 2Vin V is maintained, and a II duration where the voltage level of −2Vin V is maintained.

In the I duration, the first, second, seventh and eighth transistors M1, M2, M7, and M8 are in the ON state, and the other transistors are in the OFF state. Accordingly, in the I duration, the first output terminal A maintains the voltage level of 2Vin V, whereas the second output terminal B maintains a voltage level of zero V.

In the II duration, the third, fourth, fifth and sixth transistors M3, M4, M5, and M6 are in the ON state, and the other transistors M1, M2, M7, and M8 are in the OFF state. Accordingly, in the II duration, the first output terminal A maintains a voltage level of zero V, whereas the second output terminal B maintains the voltage level of −2Vin V.

Figure 10:
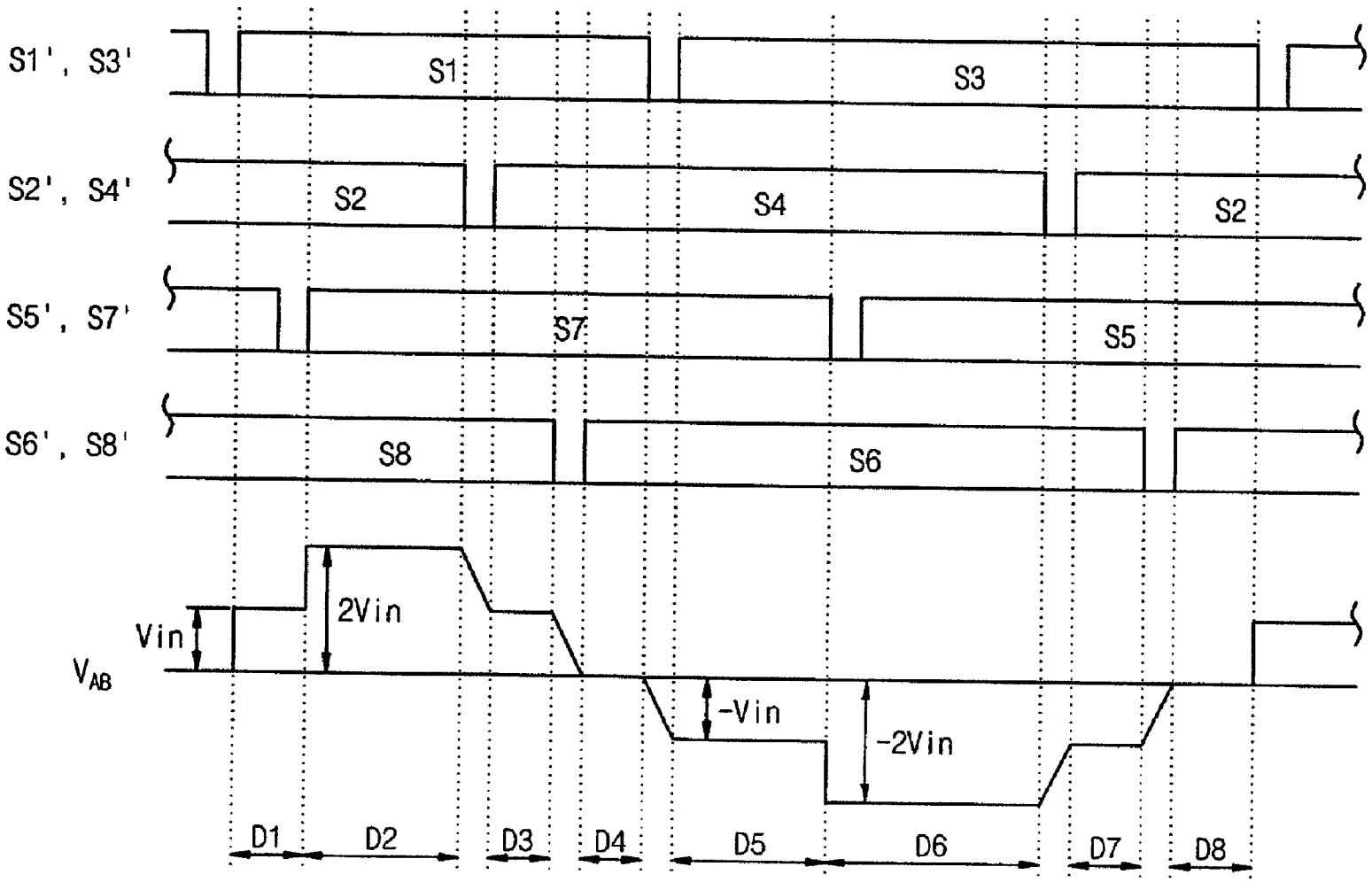
FIG. 10 is a waveform diagram illustrating signal waveforms based on input and output of first and second voltage converters according to an exemplary embodiment of the present invention.

FIG. 10 is a waveform diagram illustrating waveforms of input and output signals of the first and second voltage converters according to an exemplary embodiment of the present invention.

In FIG. 10, eight clock signals S1', S2' . . . S7', and S8' respectively input into transistors M1, M2 . . . M7, and M8 are represented. Each of the transistors M1, M2 . . . M7, and M8 start a switching operation at a different time based on the eight respective clock signals S1', S2' . . . S7', and S8'.

The combination of the eight clock signals S1', S2' . . . S7', and S8' as illustrated in FIG. 10 generates a step-square-wave AC voltage $V_{AB}$ having five voltage levels. The five voltage levels include 2Vin, Vin, 0, −Vin, and −2Vin.

One cycle of the step-square-wave AC voltage $V_{AB}$ illustrated in FIG. 10 includes a D1 duration maintaining a voltage level of Vin V, a D2 duration maintaining a voltage level of 2Vin V, a D3 duration maintaining a voltage level of Vin V, a D4 duration maintaining a voltage level of zero V, a D5 duration maintaining a voltage level of −Vin V, a D6 duration maintaining a voltage level of −2Vin V, a D7 duration maintaining a voltage level of −Vin V, and a D8 duration maintaining a voltage level of zero V.

In the D1 duration, the first, second, fifth, and eighth transistors M1, M2, M5, and M8 are in the ON state, and the other transistors are in the OFF state. Accordingly, the first output terminal A maintains the voltage level of Vin V, whereas the second output terminal B maintains the voltage level of zero V.

In the D2 duration, the first, second, seventh, and eighth transistors M1, M2, M7, and M8 are in the ON state, and the other transistors are in the OFF state. Accordingly, the first output terminal A maintains the voltage level of 2Vin V, whereas the second output terminal B maintains the voltage level of zero V.

In the D3 duration, the first, fourth, seventh, and eighth transistors M1, M4, M7, and M8 are in the ON state, and the other transistors M2, M3, M5, and M6 are in the OFF state. Accordingly, the first output terminal A maintains the voltage level of Vin V, whereas the second output terminal B maintains the voltage level of zero V.

In the D4 duration, the first, fourth, sixth, and seventh transistors M1, M4, M6, and M7 are in the ON state, and the other transistors M2, M3, M5, and M8 are in the OFF state. Accordingly, the first and second output terminals A and B maintain the voltage level of Vin V Consequently, no voltage difference shows between the first and second output terminals A and B, so that the voltage difference between the first and second output terminals A and B is the voltage level of zero V.

In the D5 duration, the third, fourth, sixth, and seventh transistors M3, M4, M6, and M7 are in the ON state, and the other transistors M1, M2, M5, and M8 are in the OFF state. Accordingly, the first output terminal A maintains the voltage level of zero V, whereas the second output terminal B maintains the voltage level of −Vin V.

In the D6 duration, the third, fourth, fifth, and sixth transistors M3, M4, M5, and M6 are in the ON state, and the other transistors M1, M2, M7, and M8 are in the OFF state. Accordingly, the first output terminal A maintains the voltage level of zero V, whereas the second output terminal B maintains the voltage level of −2Vin V.

In the D7 duration, the second, third, fifth, and sixth transistors M2, M3, M5, and M6 are in the ON state, and the other transistors M1, M4, M7, and M8 are in the OFF state. Accordingly, the first output terminal A maintains the voltage level of zero V, whereas the second output terminal B maintains the voltage level of −2Vin V.

In the D8 duration, the second, third, fifth, and eighth transistors M2, M3, M5, and M8 are in the ON state, and the other transistors M1, M4, M6, and M7 are in the OFF state. Accordingly, the first output terminal A maintains the voltage level of zero V, whereas the second output terminal B maintains the voltage level of −2Vin V.

As illustrated in FIGS. 8, 9 and 10, the clock signals S1, S2, S3 and S4 may be combined to generate a variety of step-square-wave AC voltages. The various types of step-square-wave AC voltage $V_{AB}$ are supplied to the third voltage converter 270.

The third voltage converter 270 is electrically connected with the first and second output terminals A and B, and generates a high AC voltage as the high-voltage lamp driving voltage, substantially having the form of a sine wave based on the step-square-wave AC voltage established between the first and second output terminals A and B.

Figure 11:
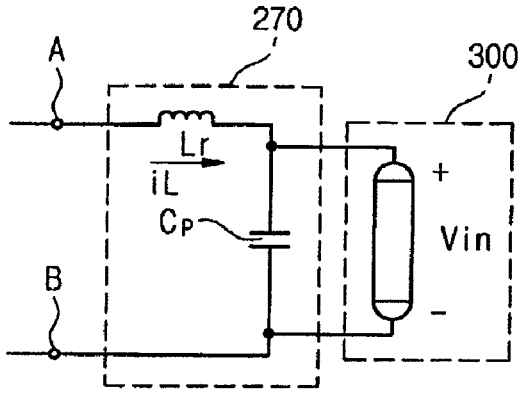
FIG. 11 is a circuit diagram for explaining a third voltage converter illustrated in FIG. 2.

FIG. 11 is a circuit diagram for explaining the third voltage converter illustrated in FIG. 2. Referring to FIG. 11, the third voltage converter 270 includes an LC resonant circuit having reactance components. The third voltage converter 270 includes an inductor Lr and a resonant capacitor Cp that are connected in series.

The inductor Lr is connected with the first output terminal A through one end thereof, and with the resonant capacitor Cp through the other end thereof. The resonant capacitor Cp is electrically connected with the other end of the inductor Lr through a first electrode thereof, and with the second output terminal B through a second electrode thereof. The lamp 300 is connected in parallel with the resonant capacitor Cp. The lamp 300 is supplied with a voltage according to a frequency characteristic of the resonant circuit having the inductor Lr and the resonant capacitor Cp.

When the step-square-wave AC voltage $V_{AB}$ as illustrated in FIGS. 8 and 9 is applied through the first and second output terminals A and B, a resonance is produced by the reactance components of the inductor Lr and the resonant capacitor Cp, thereby generating a high voltage capable of driving the lamp 300.

Figure 12:
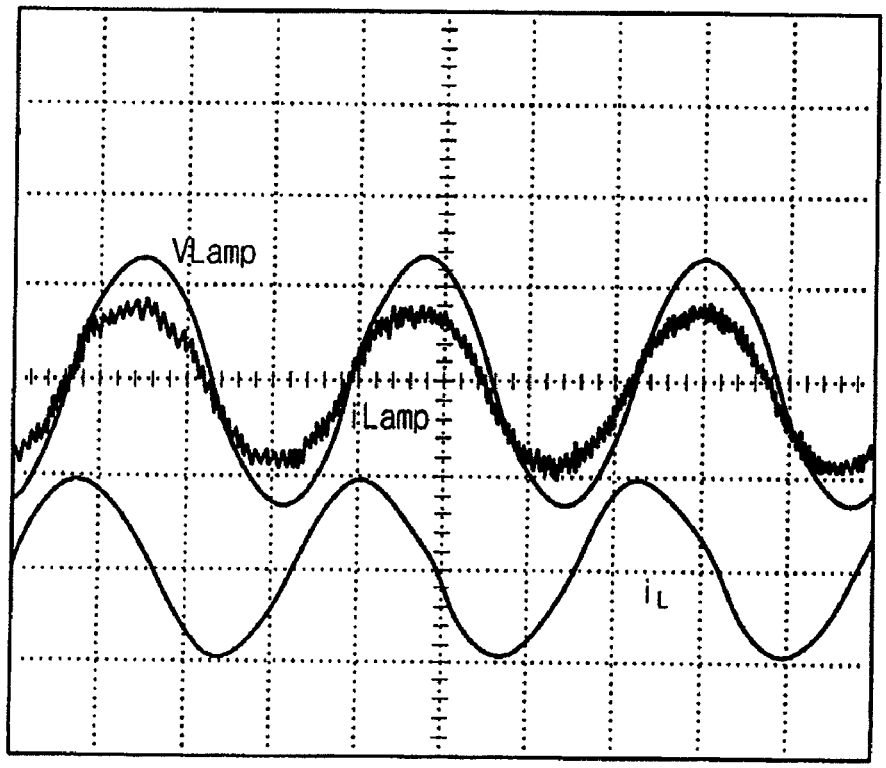
FIG. 12 is a graph illustrating operating waveforms of an LC resonant circuit illustrated in FIG. 11.

FIG. 12 is a graph illustrating operating waveforms of the LC resonant circuit of the third voltage converter in FIG. 3. Referring to FIG. 12, when the step-square-wave AC voltage $V_{AB}$ is applied to opposite ends A and B of the LC resonant circuit, a current $i_L$ of the inductor Lr and a voltage $V_{Lamp}$ of the lamp 300 have a phase difference of 90° therebetween depending on the reactance. When a clock frequency of the clock signal S1 becomes equal to a resonant frequency of the LC resonant circuit, the voltage of the lamp 300 has a phase leading by 90° as compared to that of the current of the inductor Lr. Afterwards, when the lamp 300 begins to emit light, the lamp 300 functions as only a load resistor, so that the voltage $V_{Lamp}$ of the lamp 300 has the same phase as the current $i_{Lamp}$ of the lamp 300.

Figure 13:
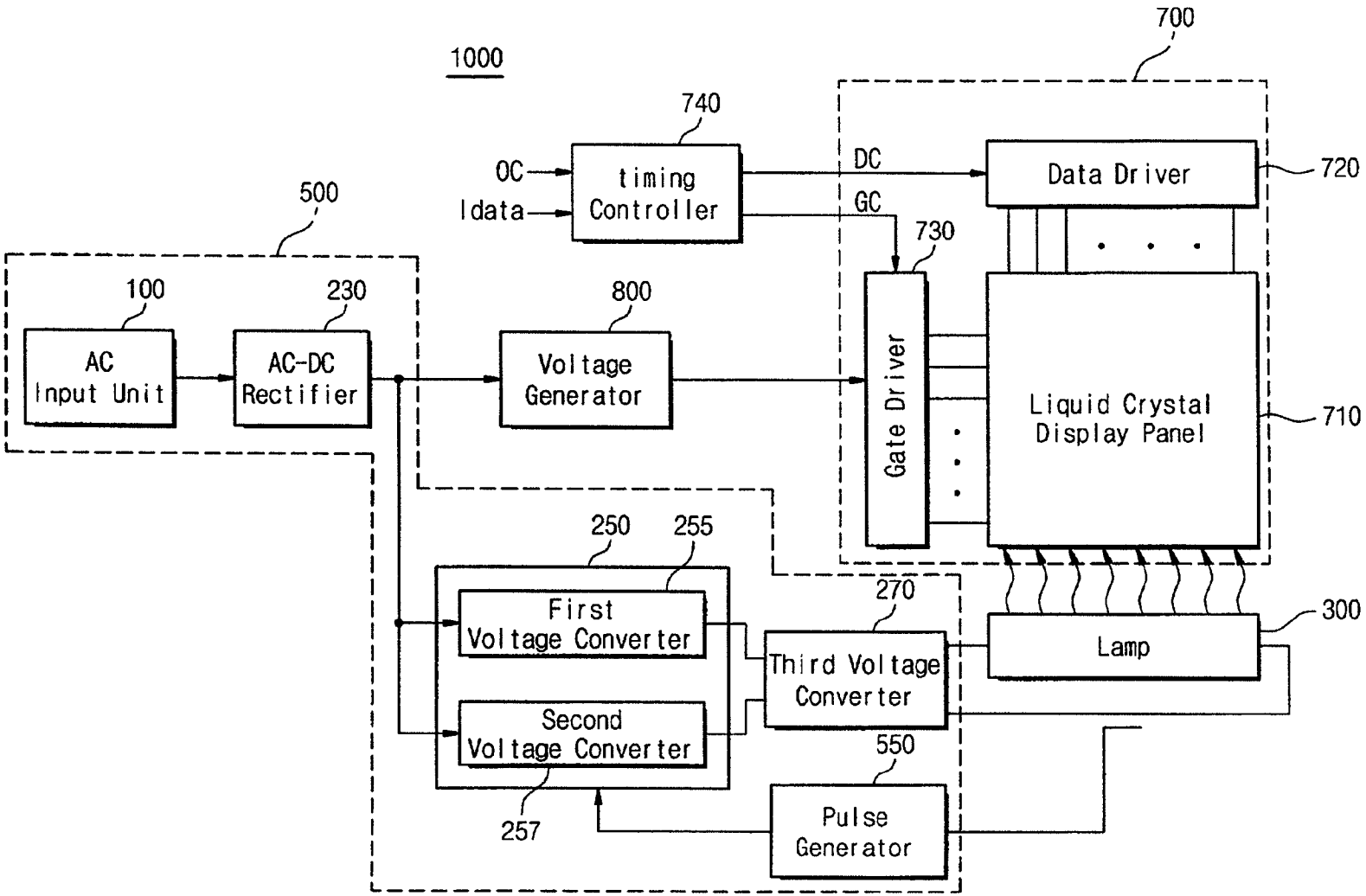
FIG. 13 is a block diagram illustrating a display apparatus having the lamp driving device illustrated in FIG. 2.

FIG. 13 is a block diagram illustrating a display apparatus having the lamp driving device illustrated in FIG. 2. In FIG. 13, the same reference numerals denote the same elements in FIG. 2, and thus detailed descriptions of the same elements is not required.

Referring to FIG. 13, a display apparatus 1000 includes a display unit 700, a timing controller 740, the lamp 300, and the lamp driving device 500. The lamp 300 is installed below the display unit 700, and includes at least one cold cathode fluorescent lamp (CCFL). The lamp 300 is supplied with the lamp driving voltage generated by the inverter 250 and the third voltage converter 270 of the lamp driving device 500, thereby emitting light to the display unit 700.

The lamp driving device 500 includes the AC input unit 100, the AC/DC rectifier 230, the inverter 250, and the third voltage converter 270. The inverter 250 includes the first voltage converter 255 and the second voltage converter 257. Since the lamp driving device 500 has been sufficiently described above with reference to FIGS. 2 through 11, a detailed description here is not required.

The display unit 700 displays an image using the light supplied from the lamp 300. The timing controller 740 receives various control signals OC and image data Idata from an external device. The timing controller 740 converts the various control signals OC to data control signals DC and gate control signals GC, and then outputs the converted signals. The timing controller 740 outputs the image data Idata at a proper timing.

The display unit 700 includes a liquid crystal display panel 710 displaying an image, and data and gate drivers 720 and 730 driving the liquid crystal display panel 710. The gate driver 730 outputs a gate signal in response to the gate control signals GC, and the data driver 720 converts and outputs the image data Idata into a pixel voltage in response to the data control signals DC. The liquid crystal display panel 710 controls alignment of a liquid crystal layer in response to the gate signal and the pixel voltage, thereby adjusting transmittance of the light supplied from the lamp 300 to display a desired image on a screen.

While the present invention has been particularly shown and described with reference to exemplary embodiments thereof, it is to be understood that the present invention is not limited to these exemplary embodiments but various changes and modifications can be made by one ordinary skilled in the art within the spirit and scope of the present invention.

What is claimed is:

1. A lamp driving device comprising:

a first voltage converter that comprises a first output terminal, converts a direct current (DC) power voltage to a first pulse voltage, and periodically outputs the first pulse voltage through the first output terminal;

a second voltage converter that comprises a second output terminal, converts the DC power voltage to a second pulse voltage having a polarity opposite to that of the first pulse voltage and a phase different from that of the first pulse voltage, and periodically outputs the second pulse voltage through the second output terminal; and a third voltage generator that is electrically connected to the first and second output terminals, wherein the third voltage generator generates an AC voltage having a swing width greater than a voltage difference between the first pulse voltage and the second pulse voltage in response to the first and second pulse voltages applied through the first and second output terminals, and supplies the generated AC voltage to a lamp.

2. The lamp driving device of claim 1, wherein the first and second pulse voltages are square waves having a phase difference of 180 degrees.

3. The lamp driving device of claim 1, wherein:

the first pulse voltage comprises a first voltage maintained during a first duration, and a second voltage maintained during a second duration following the first duration;

the second pulse voltage comprises a third voltage maintained during a third duration following the second duration and having a polarity opposite to that of the first voltage, and the second voltage maintained during a fourth duration following the third duration; and the first and third voltages have a voltage level corresponding to two times that of the DC power voltage, and the second voltage is ground voltage.

4. The lamp driving device of claim 3, wherein the first voltage converter comprises:

a first voltage booster that converts a potential of the first output terminal to the first voltage in response to a first clock signal; and a first ground part that converts the potential of the first output terminal to the second voltage in response to a second clock signal having a high level during a low duration of the first clock signal.

5. The lamp driving device of claim 4, wherein the first duration of the first voltage corresponds to a high duration of the first clock signal, and the second duration of the second voltage corresponds to a high duration of the second clock signal.

6. The lamp driving device of claim 5, wherein the first clock signal and the second clock signal have a phase difference of 180 degrees.

7. The lamp driving device of claim 4, wherein the first voltage booster comprises:

a first transistor configured to have a control electrode receiving the first clock signal, an input electrode receiving the DC power voltage, and an output electrode connected with the first ground part;

a second transistor configured to have a control electrode receiving the first clock signal, an input electrode connected to a first node, and an output electrode connected with the first output terminal;

a first diode configured to have an anode terminal connected with the input electrode of the first transistor and a cathode terminal connected with the first node; and a first capacitor configured to have a first electrode connected with the first node and a second electrode connected with the first ground part.

8. The lamp driving device of claim 7, wherein the first ground part comprises:

a third transistor configured to have a control electrode receiving the second clock signal, an output electrode receiving the ground voltage, and an input electrode connected with the output electrode of the first transistor; and a fourth transistor configured to have a control electrode receiving the second clock signal, an input electrode connected to the second electrode of the first capacitor, and an output electrode connected with the first output terminal.

9. The lamp driving device of claim 3, wherein the second voltage converter comprises:

a second voltage booster that converts a potential of the second output terminal to the third voltage in response to a third clock signal; and a second ground part that converts the potential of the second output terminal to a fourth voltage in response to a fourth clock signal having a high level during a low duration of the third clock signal.

10. The lamp driving device of claim 9, wherein the third duration of the third voltage corresponds to a high duration of the third clock signal, and the fourth duration of the second voltage corresponds to a high duration of the fourth clock signal.

11. The lamp driving device of claim 10, wherein the third clock signal and the fourth clock signal have a phase difference of 180 degrees.

12. The lamp driving device of claim 9, wherein the second voltage booster comprises:

a fifth transistor configured to have a control electrode receiving the third clock signal, an input electrode receiving the ground voltage, and an output electrode connected with the second ground part;

a sixth transistor configured to have a control electrode receiving the third clock signal, an input electrode connected to a second node, and an output electrode connected with the second output terminal;

a second diode configured to have an anode terminal connected with the input electrode of the fifth transistor and a cathode terminal connected with the second node; and a second capacitor configured to have a first electrode connected with the second node and a second electrode connected with the second ground part.

13. The lamp driving device of claim 12, wherein the second ground part comprises:

a seventh transistor configured to have a control electrode receiving the fourth clock signal, an input electrode receiving the DC power voltage, and an output electrode connected with the output electrode of the fifth transistor; and an eighth transistor configured to have a control electrode receiving the fourth clock signal, an input electrode connected to the second electrode of the second capacitor, and an output electrode connected with the second output terminal.

14. The lamp driving device of claim 1, wherein:

the first pulse voltage comprises a fifth voltage maintained during a fifth duration;

the second pulse voltage comprises a sixth voltage maintained during a sixth duration following the fifth duration and having a polarity opposite to that of the fifth voltage; and the fifth and sixth voltages have a voltage level corresponding to two times that of the DC power voltage.

15. The lamp driving device of claim 1, wherein:

the first pulse voltage comprises a seventh voltage maintained during a seventh duration, an eighth voltage maintained during an eighth duration following the seventh duration, the seventh voltage maintained during a ninth duration following the eighth duration, and a ninth voltage maintained during a tenth duration following the ninth duration;

the second pulse voltage comprises a tenth voltage maintained during an eleventh duration following the tenth duration and having a polarity opposite to that of the seventh voltage, an eleventh voltage maintained during a twelfth duration following the eleventh duration and having a polarity opposite to that of the eighth voltage, the tenth voltage maintained during a thirteenth duration following the twelfth duration, and the ninth voltage maintained during a fourteenth duration following the thirteenth duration; and the seventh voltage has the same voltage level as the DC power voltage, the eighth voltage has a voltage level corresponding to two times that of the DC power voltage, and the ninth voltage is the ground voltage.

16. The lamp driving device of claim 1, wherein the third voltage converter comprises an LC resonant circuit having reactance components.

17. The lamp driving device of claim 16, wherein the LC resonant circuit comprises:

an inductor connected with the first output terminal at one end thereof; and a resonant capacitor having a first electrode connected with another end of the inductor and a second electrode connected with the second output terminal.

18. The lamp driving device of claim 1, wherein each of the first and second pulse voltages has a voltage level greater than that of the DC power voltage.

19. A display apparatus comprising:

a display unit receiving a light to display an image;

a lamp receiving an alternating current (AC) voltage to emit the light; and a lamp driving device supplying the AC voltage to the lamp, wherein the lamp driving device comprises:

a first voltage converter that has a first output terminal, converts a direct current (DC) power voltage to a first pulse voltage, and periodically outputs the converted first pulse voltage through the first output terminal;

a second voltage converter that has a second output terminal, converts the DC power voltage to a second pulse voltage having a polarity opposite to that of the first pulse voltage and a phase different from that of the first pulse voltage, and periodically outputs the converted second pulse voltage through the second output terminal; and a third voltage generator that is electrically connected to the first and second output terminals, wherein the third voltage generator generates the AC voltage having a swing width greater than a voltage difference between the first pulse voltage and the second pulse voltage in response to the first and second pulse voltages applied through the first and second output terminals, respectively, and supplies the generated AC voltage to the lamp.

20. The display apparatus of claim 19, wherein the lamp comprises at least one lamp that receives the AC voltage to supply the light to the display unit.

21. The display apparatus of claim 20, wherein the lamp comprises a cold cathode fluorescent lamp.

22. The display apparatus of claim 19, wherein each of the first and second pulse voltages has a voltage level greater than that of the DC power voltage.

* * * * *